US006261013B1

(12) United States Patent
Bryer et al.

(10) Patent No.: US 6,261,013 B1
(45) Date of Patent: Jul. 17, 2001

(54) DOOR MOUNTED ROLL SUPPORT

(75) Inventors: Phillip Bryer, Tarzana; Steve Chillscyzn; Caleb Bryant, both of Moorpark, all of CA (US)

(73) Assignee: Eltron International, Inc., Camarillo, CA (US)

( * ) Notice: Subject to any disclaimer, the term of this patent is extended or adjusted under 35 U.S.C. 154(b) by 0 days.

(21) Appl. No.: 09/411,020

(22) Filed: Oct. 4, 1999

Related U.S. Application Data

(60) Provisional application No. 60/127,348, filed on Apr. 1, 1999.

(51) Int. Cl.[7] ..... B41J 11/26

(52) U.S. Cl. ..... 400/613; 400/644; 400/663; 400/703; 400/708; 400/711

(58) Field of Search ..... 400/611, 613, 400/613.1, 617, 618, 619, 621, 644, 703, 708, 663, 711; 347/109

(56) References Cited

U.S. PATENT DOCUMENTS

| | | | | |
|---|---|---|---|---|
| 4,014,426 | * | 3/1977 | Neufeld | 400/613 |
| 4,860,031 | * | 8/1989 | Lejcek | 400/613 |
| 5,110,226 | * | 5/1992 | Sherman et al. | 347/109 |
| 5,163,766 | | 11/1992 | Fushimi et al. . | |
| 5,230,576 | * | 7/1993 | Sone | 400/613 |
| 5,348,407 | * | 9/1994 | Hock et al. | 400/711 |
| 5,806,993 | * | 9/1998 | Petterutti et al. | 400/613 |
| 5,860,753 | | 1/1999 | Bech et al. . | |
| 6,092,945 | * | 7/2000 | Takami et al. | 400/613 |
| 6,099,179 | * | 8/2000 | Higashi et al. | 400/613 |
| 6,109,805 | * | 8/2000 | Ono et al. | 400/613 |

FOREIGN PATENT DOCUMENTS

| | | | | |
|---|---|---|---|---|
| 402139270A | * | 5/1990 | (JP) | 400/711 |

OTHER PUBLICATIONS

Patent Abstracts of Japan, Publication No. 60115471, Publication date Jun. 21, 1985 (Application No. 58222958, Application date Nov. 26, 1983).

Patent Abstracts of Japan, Publication No. 06237323, Publication date Aug. 23, 1994 (Application No. 05043398, Application date Feb. 9, 1993).

* cited by examiner

*Primary Examiner*—Eugene Eickholt
(74) *Attorney, Agent, or Firm*—Fulbright & Jaworski L.L.P.

(57) ABSTRACT

A portable printer comprising a door pivotally coupled to a main body of the portable printer at a back end, a printing medium roller support rotatably mounted on the door of the portable printer, a platen rotatably positioned at a front end of the door, a door locking mechanism having a pair of door locking latches respectively positioned at opposite ends of the platen, a roller movably and rotatably coupled to the door locking mechanism and positioned parallel to the platen, a pair of levers movably coupled to the door locking mechanism for pressing the roller against the platen when the door is closed to the main body, a support frame positioned within the main body, a print head pivotally coupled to the support frame, a pair of coil springs coupled between the print head and the support frame such that the print head is essentially floating against the support frame, a body locking mechanism having a pair of body locking latches for latching with respective door locking latches, a gear system coupled to the platen for rotating the platen, a door lock preventing the door locking mechanism from being pressed to release the door, a printing medium sensor and a status indicating lamp for sensing and reporting the status of the printing medium roll, wherein the medium roller support is mounted on the door for easy accesses of the printing medium roll and the print head is adjustably positioned against the platen.

39 Claims, 3 Drawing Sheets

DOOR MOUNTED ROLL SUPPORT

RELATED APPLICATION

This application is an U.S. application claiming the benefit of the U.S. Provisional Application No. 60/127,348, filed on Apr. 1, 1999, the contents of that application are incorporated herein by reference.

FIELD OF THE INVENTION

The present invention relates generally to an image producing device and more particularly to a portable printing device having a door-mounted roller support mechanism for easier access to a printing medium roll mounted thereon.

BACKGROUND OF THE INVENTION

The conveniences provided by portable printers have made them widely used in the modern business settings for many years. For instance, a person supervising rental car returns often wears a portable printer on his/her belt for printing car rental information or for communicating information to his/her rental car company's main computer. By virtue of carrying a portable printer, the person may print out return information and/or receipts at the parking lot where the rental cars are returned, without the need of going back to the rental office to complete the transactions. The portable printers, thus, save tremendous amounts of time and trouble for customers and they dramatically improve efficiencies of many business transactions.

There are many different designs of portable printers available on the market. However, only two forms of printing mediums, namely, a separate-sheet form or a medium-roll form, are predominantly used for all printers, whether portable or not. Each printer thus has its specifically designed feeding mechanism to receive either one form of the printing medium, or both. For a typical small-sized portable printer, the medium-roll form is the principal printing medium form used.

The printing medium may be made of sheets of paper or labels attached to protective backings. For the separate-sheet printing medium form, each sheet of paper or each label is separately fed into the printer for printing. Conversely, the medium-roll form of a printing medium is formed by a continuous paper or label strip fed into the printer by a roller feeding mechanism built into the printer. The continuous strip may have periodic perforations to facilitate tearing the strip of the printing medium apart. Alternatively, other tearing mechanisms may be adopted by the printer to tear the strip of the printing medium roll.

Having a medium roll as the printing medium form is particularly desirable for most portable printers. Preferably, a portable printer should be small and lightweight, as compared to a regular non-portable printer. Moreover, the portable printer is often designed to print simple receipts, or similar business records. Thus, there is less need of using standard-size business papers for the portable paper. In addition, the medium-roll form is easier to handle for a small size printing medium. As a result, most portable printers use the medium-roll form printing mediums.

A conventional portable printer generally has a print head for forming images on the printing medium, a platen for pressing the printing medium against the print head and for moving the printing medium, a feeding mechanism for feeding the printing medium to the print head, and a door to be opened for accessing or replacing the printing medium. The feeding mechanism often comprises a medium roller for mounting a printing medium roll thereon, and a motor for rotating the platen and/or the medium roller to move the printing medium toward the print head.

As the printing medium passes through the portable printer, the printing medium needs to be carefully aligned throughout an internal medium path of the portable printer for a good quality printout. The internal medium path starts from the printing medium roll to the print head and the platen until the printing medium comes out of the portable printer. Thus, the platen of the portable printer should be aligned with the print head to press and move the printing medium properly. The medium roller also has to be carefully situated in the portable printer in order to assure the alignment of the printing medium with the print head. Otherwise, skipped printings, double printings, paper jam, and many other problems might happen due to the misalignment problem of the printing medium in the portable printer. As a result, the print head, the platen, and the medium roller are typically positioned in the vicinity of each other, and a conventional portable printer typically has a single bracket for holding the print head and the platen together to reduce the likelihood of misalignment problems.

Placing the print head and the platen on a single bracket does reduce the likelihood of misalignment problems for a conventional portable printer. It, however, has drawbacks of inconvenience in replacing the printing medium, for it necessitates threading the printing medium between the print head and the platen. Also, the medium roller of the conventional printer is often positioned inside the portable printer and is hard to reach. Thus, to replace a printing medium in the conventional portable printer, a user has to open the printer door, take off a used printing medium roll, insert a new printing medium roll, carefully thread the strip of the new medium roll between the platen and the print head, and then close the door of the portable printer. These steps, taken as a whole, are quite time-consuming to perform. It is particularly inconvenient if the portable printer is mounted on the belt of the user, such as the person supervising the rental car returns. To replace the printing medium roll in the conventional portable printer, that person will necessarily have to take the printer off the belt and have it reinstalled on the belt after reloading the printing medium roll.

SUMMARY OF THE INVENTION

An object of the present invention is to provide a mechanism to a portable printer for conveniently replacing the printing medium roll without running into the misalignment problems which typically happen to a conventional portable printer. This object is met by providing a door mounted roller support together with an automated dispense mode engagement according to the present invention, as indicated in the claims appended hereto.

The present invention comprises a portable printer having a medium roller support mounted on a door of the portable printer. The portable printer also comprises a platen positioned on the door and a print head positioned on a main body of the portable printer. The print head is movably supported by a suspension mechanism. Thus, the print head could be properly aligned with the platen when the printer door is closed to the main body. The present invention also has a gearing mechanism functioning to rotate the platen for moving the printing medium.

The foregoing and additional features and advantages of this present invention will become apparent by way of non-limitative examples shown in the accompanying drawings and detailed description that follow. In the figures and written description, numerals indicate the various features of the invention, like numerals referring to like features throughout for both the drawing figures and the written description.

BRIEF DESCRIPTION OF THE INVENTION

DETAILED DESCRIPTION OF THE INVENTION

Figure 1:
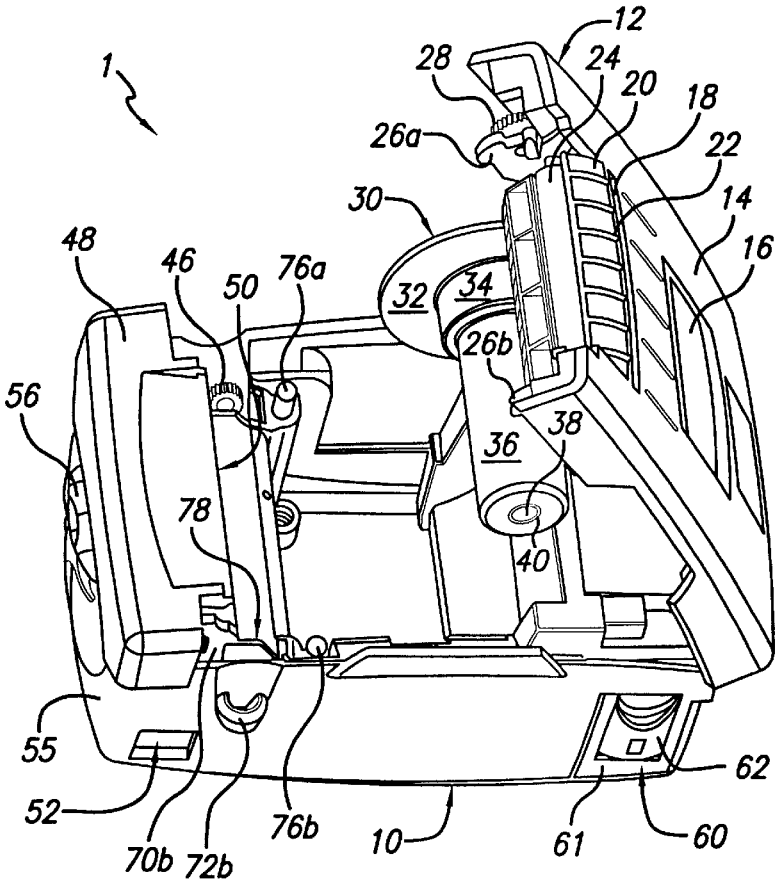
FIG. 1 shows a perspective view of a portable printer according to the present invention.
Figure 2:
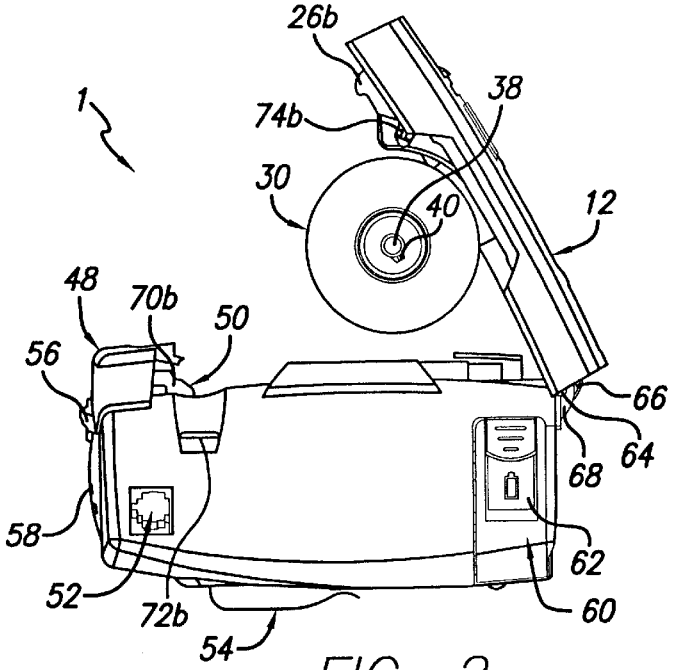
FIG. 2 shows a right side elevational view of the portable printer of FIG. 1.
Figure 3:
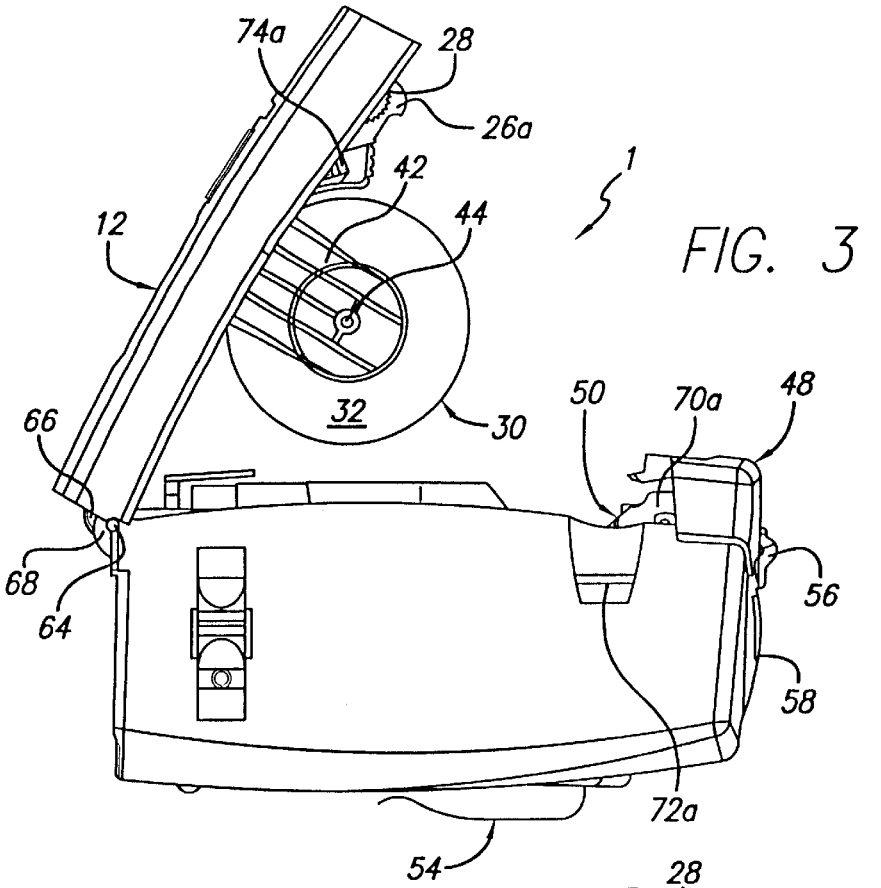
FIG. 3 shows a left side elevational view of the portable printer of FIG. 1.

FIG. 1 illustrates a perspective view of a portable printer 1 according to the present invention. In FIG. 1, the portable printer 1 has a main body 10 and a door 12 pivotally coupled to the main body 10 at a back end. A pivot shaft 64 threads through meshing teeth 66, 68 respectively of the door 12 and the main body 10 to pivotally connect them at the back end of the portable printer 1, as shown in FIGS. 2, 3. Thus, the door 12 may be opened up to approximately 80° for accessing inside the main body 10 of the portable printer 1.

A holding rack 42 extends perpendicularly inward from the underside of the door 12 near the left side for holding a medium roller support 30, as shown in FIG. 3. The holding rack 42 may be an integrated part of the door 12, or it may be securely attached to the door 12 by a fixing means. In a preferred embodiment, the holding rack 42 is an integrated part of the door 12 and is made of same materials as of the door 12.

Shown in FIG. 1, the medium roller support 30 has a left paddle end 32, a support arm 36, and a neck section 34 integrally connecting the left paddle end 32 and the support arm section 36. The overall lateral length of the medium roller support 30 is approximately 1.75 inches long. The main body 10 has a printing medium room, which is approximately 3.3 inches wide, 5 inches long, and 2.2 inches deep. The printing medium room is sufficiently large to house the medium roller support 30, together with a printing medium roll to be mounted thereon. Thus, when the door 12 is closed, the medium roller support 30 may hold the printing medium roll to be housed within printing medium room of the main body 10 during operation.

The left paddle end 32 of the medium roller support 30 has a flat ring shape having an outer diameter of approximately 2.1 inches and an inner diameter of approximately 0.75 inches. The neck section 34 is shaped like a cylindrical tunnel with an outer diameter of approximately 0.85 inches and stepped inner diameters of approximately 0.75 inches and 0.7 inches respectively. A first end of the neck section 34 is perpendicularly integrated to the inner diameter of the left paddle end 32, and a second end, opposite to the first, of the neck section 34 is integrally coupled to a first end of the support arm section 36. The support arm section 36 also has a cylindrical tunnel shape with an outer diameter of approximately 0.7 inches and an inner diameter of approximately 0.5 inches. Thus, the neck section 34 and the support arm section 36 together form a stepped-cylindrical room inside the medium roller support 30.

A roller support shaft 38 is positioned inside throughout the length of the stepped-cylindrical room of the medium roller support 30 such that the medium roller support 30 is rotatably coupled to the roller support shaft 38. The roller support shaft 38 has a diameter of approximately 0.25 inches and a length of approximately 2.5 inches long. Furthermore, a second end, opposite to the first, of the support arm section 36 is partially closed and has a shaft hole having a diameter slightly larger than the diameter of the roller support shaft 38 to allow the roller support shaft 38 to thread through. At a first end near the left paddle end 32, the roller support shaft 38 is coupled to the holding rack 42 by a connecting means 44 for holding the medium roller support 30. In the preferred embodiment, the connecting means 44 includes a screw adapted to screw through a hole of the holding rack 42 into the roller support shaft 38 for securing the roller support shaft 38 and holding the medium roller support 30.

In the preferred embodiment, a coil spring mechanism (not shown) is positioned within the stepped-cylindrical room of the neck section 34. The coil spring mechanism encircles the roller support shaft 38 allowing the medium roll support 30 to be laterally pressed to the left until the left paddle end 32 is stopped by the holding rack 42. In alternative embodiments, other types of elastic mechanisms may be adopted to replace the coil spring mechanism. The coil spring mechanism has a holding frame with a lateral length of approximately 0.5 inches, and the roller support shaft 38 is tightly threaded through the holding frame of the coil spring mechanism horizontally.

Figure 4:
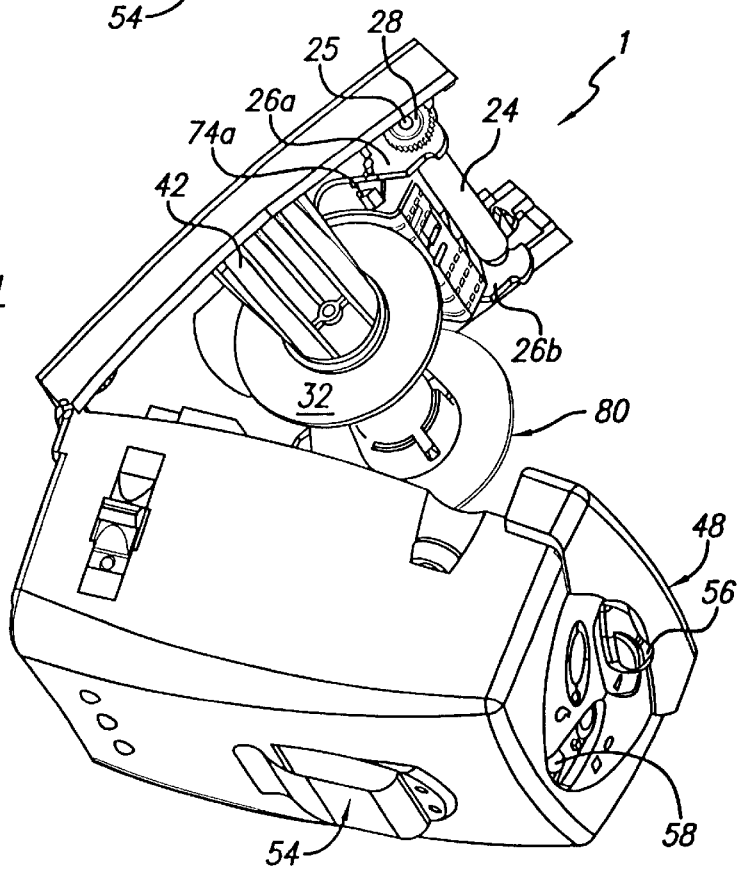
FIG. 4 shows a perspective view from lower left side of the portable printer of FIG. 1.

In one embodiment, the roller support shaft 38 has a circular groove near a second end, opposite to the first, for receiving a stop 40 fitted onto the circular groove. The stop 40 has a generally ring shape having an opening wherein two extrusions respectively extend outwardly from opposite sides of the opening. The two extrusions of the stop 40 help grasp and expand the ring-shape stop 40 for installing or uninstalling onto the circular groove. When mounted on the roller support shaft 38, the outer diameter of the stop 40 extends slightly outward of the roller support shaft 38, but no part of the stop 40 will extend beyond the outer diameter of the support arm 36. In one embodiment, the stop 40 is made of metallic materials. However, any other suitable materials may be used for making the stop 40. The coil spring mechanism 31 urges the second end of the support arm 36 against the stop 40. Because the stop 40 is fitted onto the circular groove of the roller support shaft 38 and cannot move laterally outside of the circular groove, the stop 40 therefore prevents the medium roller support 30 from falling off the roller support shaft 38. As noted, the horizontal length of the medium roller support 30 is shorter than the lateral length of the roller support shaft 38. Therefore, the medium roller support 30 may move laterally along the roller support shaft 38 between the stop 40 and the holding rack 42 by pressing back against the coil spring mechanism 31. In an alternative embodiment, a right paddle end 80 may be positioned at the second end, i.e., the right end, of the roller support shaft 38, as shown in FIG. 4. The right paddle end 80 functions to prevent the printing medium roll mounted on the medium roller support 30 from falling off the medium roller support 30.

An opening 16 is positioned on a top surface 14 of the door 12. In the preferred embodiment of the present invention, the opening 16 is approximately 1.75 inches wide and 0.9 inches long and is partially above the medium roller support 30 mounted on the door 12. Thus, a user may check the status of the printing medium roll held by the medium roller support 30 by looking through the opening 16. A rectangular stripping slope 20 is located on the top surface 14 near the front end of the door 12, and a rectangular slot 18 is located on the top surface 14 between the stripping slope 20 and the opening 16. The slot 18 is parallel to the stripping slope 20 with a distance of approximately 0.1 inches between them. An optional transparent lid (not shown) may also be positioned on the top surface 14. The transparent lid has a size similar to the size of the opening 16 so that it may cover the opening 16 to prevent dusts from entering into the printer 1. The slot 18 is approximately 2.2 inches wide and 0.16 inches long. Correspondingly, the stripping slope 20 is approximately 2.2 inches wide and 0.48 inches long. Beginning from the top surface 14 near the slot 18, the stripping slope 20 angles downward toward the front end by approximately 40° relative to the horizontal top surface 14 having a slop length of approximately 0.48 inches.

The printing medium roll, such as a label roll, is typically formed by winding a continuous strip of printing medium, such as a label strip having labels attached to a continuous strip protective backing, over a cylindrical roll holder. To load the label strip in the portable printer 1, the label roll is first mounted on the medium roller support 30 by inserting the cylindrical roll holder onto the neck section 34 and the support arm section 36. The label strip is pulled from the label roll toward the front end of the main body 10 and is then turned backward over a platen 24, as shown in FIG. 6. The protective backing has a gloss surface facing the labels allowing the labels to be peeled off effortlessly. The labels are glued to the protective backing, but the adhesive force of the glue is not very strong so that when the label strip is bent over a critical angle, e.g. 30°, the label right over the bent part will separate from the protective backing and will move tangentially with respect to the protective backing. After the label strip passes the platen 24, the protective backing moves downward to be threaded between a roller 82 and the platen 24 and then proceeds upwards to come out of the top surface 14 through the slot 18. As shown in FIG. 6, the positions of the platen 24, the roller 82, and the slot 18 are properly arranged to cause the label strip to be bent over the critical angle. In the preferred embodiment, the platen 24 has a cylindrically shaped pressing member having an outer diameter of approximately 0.35 inches and a length of approximately 2.17 inches. The pressing member of the platen 24 tightly encircles a platen shaft 25, which has a diameter of approximately 0.16 inches and a length of approximately 2.92 inches, as shown in FIG. 4. The pressing member of the platen 24 and the platen shaft 25 may be respectively made of any suitable materials that are widely known by persons skilled in the art. Similarly, the roller 82 has a roller pressing member made of TEFLON materials with an outer diameter of approximately 0.29 inches and a length of approximately 2.1 inches. The roller pressing member of the roller 82 also tightly encircles a roller shaft 83 having a diameter of approximately 0.13 inches and a length of approximately 2.68 inches, as shown in FIG. 5.

As stated, the labels will move tangentially with respective to the protective backing when they are passing the bending point where the protective backing starts to be threaded downward between the roller 82 and the platen 24. The stripping slope 20 is positioned above the roller 82 and the angle of the stripping slope 20 is chosen such that the labels will move roughly parallel to and over the stripping slope 20 after the labels move past the bending point. Thus, the labels will be automatically parted from the protective backing after passing the platen 24 and will come out of the top surface 14 from over the stripping slope 20, while the protective backing will come out of the top surface 14 through the slot 18. As a consequence, the slot 18 and the stripping slope 20 jointly function to separate labels and the protective backing after the labels have been printed. Moreover, a plurality of ridges are positioned on the stripping slope 20. In the preferred embodiment, there are seven ridges on the stripping slope 20, but the number of ridges may vary according to the length of the stripping slope 20. Each of the ridges 22 has a very narrow width and they extend perpendicular outward from the stripping slope 20 for approximately 0.05 inches. The ridges 22 of the stripping slope 20 help prevent the printed labels from sticking to the stripping slope 20. Thus, the labels may smoothly come out of the portable printer 1 over the stripping slope 20, and the protective backing will come out of the portable printer 1 through the slot 18. As a result, the user needs not to manually peel the label off the protective backing.

A door locking mechanism 26 is positioned at an underside of the door 12, partly under the stripping slope 20. The door locking mechanism 26 has a pair of door locking latches 26*a*, 26*b* positioned at opposite ends (left and right) of the door 12, as shown in FIG. 1. A pair of platen receptive holes are respectively positioned on the door locking latches 26*a*, 26*b*. The platen 24 is positioned between the door locking latches 26*a*, 26*b* and has the platen shaft 25 rotatably coupled to the door locking mechanism 26 through the respective platen receptive holes of the door locking latches 26*a*, 26*b*. Diameters of the platen receptive holes are slightly larger than a diameter of the platen shaft 25 to allow the platen shaft 25 to freely thread through. The door locking latches 26*a*, 26*b* are approximately 2.6 inches away from each other to allow some lateral movement of the platen 24 between the door locking latches 26*a*, 26*b*. The platen shaft 25 is further coupled to a gear 28 positioned at the outer side of the left door locking latch 26*a*, opposite to the side of the pressing member of the platen 24. The platen 24 tightly presses the printing medium against the roller 82 during operation. Thus, the gear 28 is adapted to rotate the platen 24 so that the platen 24 and the roller 82 may move the printing medium through the printer 1. Each of the door locking latches 26*a*, 26*b* has an extrusion part respectively facing toward the front end of the portable printer 1 when the door 12 is closed. The extrusion parts of the door locking latches 26*a*, 26*b* respectively has a cam shape at the front end and a recess having an approximately flap top surface functioning as a latch to lock the door 12 to the main body 10, which will be explained in more detailed.

Figure 5:
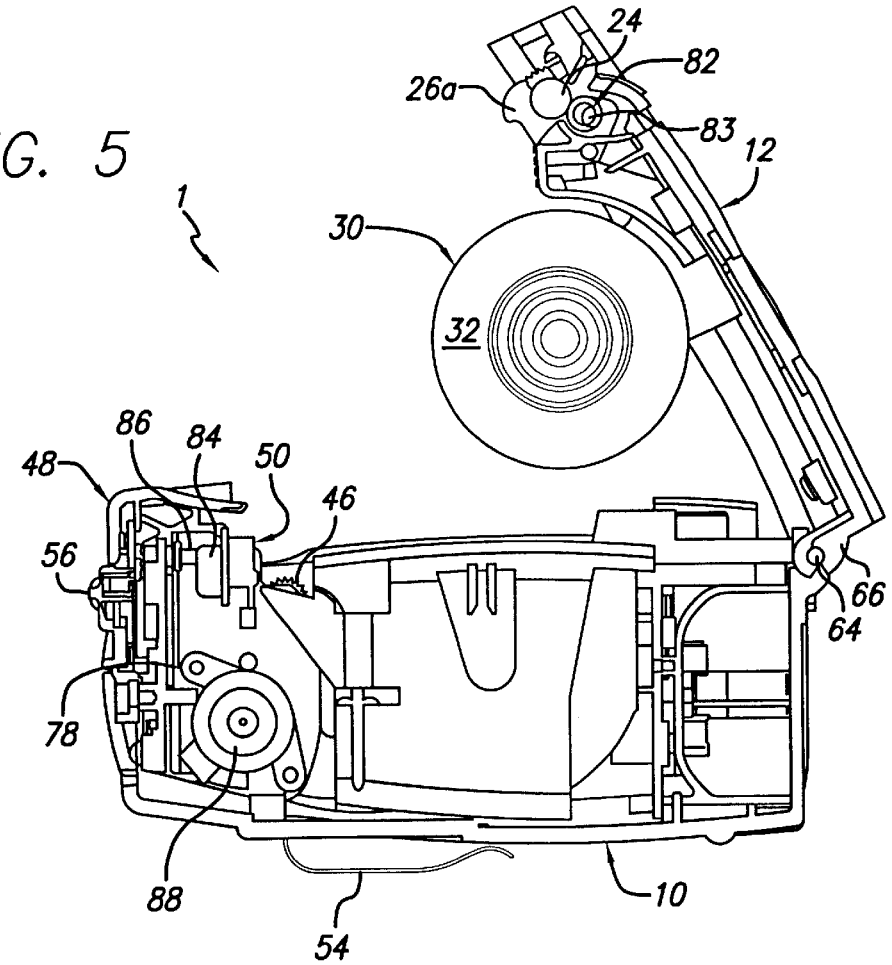
FIG. 5 shows a cross-section elevational view of the portable printer of FIG. 1.
Figure 6:
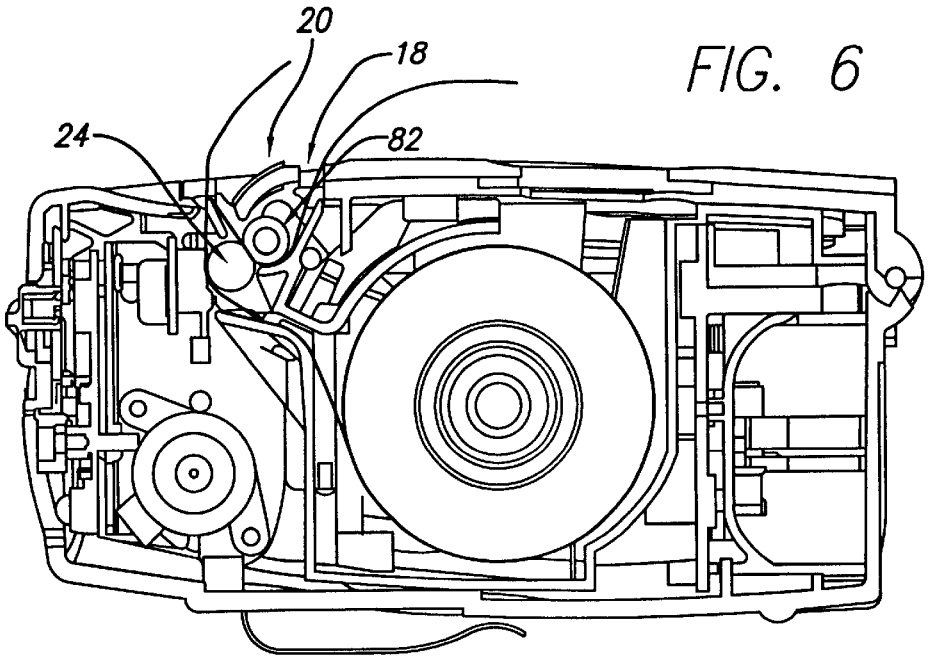
FIG. 6 shows a cross-sectional view illustrating a protective backing and a label of a label roll separated by a roller and a platen of the portable printer of FIG. 1.

As stated, the roller 82 is movably and rotatably positioned under the stripping slope 20 and is approximately parallel to the platen 24, as shown in FIGS. 5 and 6. The roller shaft 83 of the roller 82 is threaded through two roller receptive holes respectively positioned on the door locking latches 26*a*, 26*b* and approximately under the slot 18. The roller receptive holes of the door locking latches 26*a*, 26*b* are of approximately elliptic shape and are larger than the diameter of the roller's shaft to allow the roller 82 to press against or move away from the platen 24. In addition, a pair (left and right) of stripper arms 74*a*, 74*b* are rotatably coupled to the respective door locking latches 26*a*, 26*b*, as shown in FIGS. 2, 3, and 4. The left and right stripper arms 74*a*, 74*b* extend behind the roller 82 and are adapted to urge the roller 82 against the platen 24. A pair of plungers 76*a*, 76*b* is located in the main body 10 respectively at left and right ends of the main body 10 corresponding to the positions of the left and right stripper arms 74*a*, 74*b*. The plungers 76*a*, 76*b* are approximately cylindrically shaped and are housed in their respective pole rooms in the main body 10, as shown in FIG. 1. Inside the pole rooms, two coil spring means respectively positioned under the plungers 76*a*, 76*b* to urge the plungers 76*a*, 76*b* upward and extending outside of the respective pole rooms. The portion of each plunger 76*a* or 76*b* that extends outside of the respective pole room is approximately 0.35 inches long, which is sufficient to contact and push the respective stripper arm 74*a* or 74*b* upward when the door 12 is closed against the main body 10. Therefore, the plungers 76*a*, 76*b* are positioned corresponding to the stripper arms 74*a*, 74*b* such that the plungers 76*a*, 76*b* may push the respective stripper arms 74*a*, 74*b*, which, in turn, urge the roller 82 against the platen 24 when the door 12 is closed against the main body 10. Conversely, when the door 12 is opened from the main body 10, the plungers 76*a*, 76*b* will be separated from the stripper arms 74*a*, 74*b*. Thus, stripper arms 74*a*, 74*b* are released from pushing the roller 82 against the platen 24, and the user may easily thread the protective backing between the roller 82 and the platen 24.

Referring to FIG. 1, a support frame 78 is positioned inside the front end of the main body 10. The support frame 78 has two frame side plates respectively positioned at opposite ends (left and right), and a central plate perpendicularly coupled between both frame side plates. A support frame shaft (not shown), of approximately 2.76 inches, is threaded through both frame side plates near their respective bottom ends. A body locking mechanism 48 also has two body side plates (left and right) respectively positioned parallel to and outside of the left and right frame side plates of the support frame 78. The left and right body side plates of the body locking mechanism 48 are also threaded through by the support frame shaft so that the body locking mechanism 48 is pivotally coupled to the support frame 78. The body locking mechanism 48 covers a top front corner of the portable printer 1 and has a pair of body locking latches 70*a*, 70*b* respectively positioned on the left and right body side plates near the top. The body locking latches 70*a*, 70*b* are also positioned corresponding to the positions of the pair of door locking latches 26*a*, 26*b* respectively. Similar to the door locking latches 26*a*, 26*b*, the body locking latches 70*a*, 70*b*, have extrusion parts respectively extending toward the back end. Each of the extrusion parts of the respective body locking latches 70*a*, 70*b* has a cam shape at the back end to allow sliding against the respective cam-shaped extrusion parts of the door locking latches 26*a*, 26*b*. The extrusion parts of the respective body locking latches 70*a*, 70*b* also respectively has a recess having an approximately flat surface facing down to latch the respective recess of the door locking latches 26*a*, 26*b*. The recesses of the door locking latches 26*a*, 26*b* are of L-shape and the recesses of the body locking mechanism 48 are of T-shape. The body locking latches 70*a*, 70*b* are properly positioned relative to the door locking latches 26*a*, 26*b* such that the respective door and body locking latches may latch with each other when the door 12 is closed against the main body 10.

A print head 50 is secured to a support rack 84, as shown in FIG. 5. The support rack 84 has a left and right small extrusion rods respectively positioned at opposite ends (left and right). The extrusion rods of the support rack 84 respectively extends through two print head receptive holes respectively positioned on the left and right frame side plates of the support frame 78. The extrusion rods of the support rack 84 respectively has a diameter of approximately 0.1 inches, and the print head receptive holes could have any shape sufficiently large to house the extrusion rods and to allow movements therein. Therefore, the extrusion rods of the support rack 84 may move freely within the print head receptive holes, and the print head 50 will move accordingly. In addition, the extrusion rods of the support rack 84 are also threaded through a pair of latching holes positioned on the body side plates respectively. Thus, when the user presses the body locking mechanism 48, the body side plates of the body locking mechanism 48 will pull the print head 50 toward the front end to help unlock the door 12 from the main body 10.

An elastic mechanism 86 is coupled between the central plate of the support frame 78 and the support rack 84, as shown in FIG. 5. The elastic mechanism 86 urges the print head 50 toward the back end of the portable printer 1, but the orientation of the print head 50 may be freely adjusted by pressing against the elastic mechanism 86. The print head 50 is also slightly movable vertically relative to the support frame 78 due to the larger size of the print head receptive holes relative to the diameter of the extrusion rods of the support rack 84. Thus, the elastic mechanism 86, in conjunction with the print head receptive holes, makes the print head 50 essentially "float" against the support frame 78. In a preferred embodiment, the elastic mechanism 86 includes a pair of coil springs, but any other alternative elastic mechanisms that serve the purpose may be adopted to accomplish the similar floating result. The central plate of the support frame 78 has two extrusion rods at the back side and the support rack 84 correspondingly has two extrusion rods at the front side facing directly against the respective extrusion rods of the support frame 78. The pair of the corresponding extrusion rods of the support frame 78 and the support rack 84 confines the corresponding coil spring therein between. Each of the coil springs in the preferred embodiment exerts an urging force of approximately 3.0 lb/inch between the print head 50 and the support frame 78. The urging forces of the coil springs determine how much force a user needs to press the body locking mechanism 48 against the coil springs for releasing the door 12. The urging forces of the coil springs also determine an adjustability of the print head 50 relative to the platen 24, as will be further elaborated in the following paragraphs.

As noted, the body locking mechanism 48 is pivotally coupled to the support frame 78 of the main body 10. When the door 12 is closing, the extrusion parts of door locking latches 26*a*, 26*b* will initially push the extrusion parts of the body locking latches 70*a*, 70*b*, and the whole body locking mechanism 48, frontward until the body locking mechanism 48 snaps back due to the meshing of the respective recesses of both locking mechanisms 26, 48. The recesses of the body locking mechanism 48 press the recesses of the door locking mechanisms 26 downward to latch the door 12 with the main body 10. The surfaces of the recesses are flat and can slide against each other for locking and/or unlocking the door 12. The elastic mechanism 86 is positioned between the support rack 84 and the central plate of the support frame 78, that is behind the front end of the main body 10, to urge the support rack 84, and thus the print head 50, toward the back end of the portable printer 1. Furthermore, extrusion rods at each ends (left and right) of the support rack 84 are inserted into the left and right latching holes of the body side plates respectively. Thus, the support rack 84 will push the body locking latches 70*a*, 70*b* of the body locking mechanism 48 backward to keep the door 12 locked when it is closed. Since the body locking mechanism 48 is pivotally coupled to the support frame 78, it can be pressed to move the body locking latches 70*a*, 70*b* frontward. To open the door 12, the user presses the body locking mechanism 48 frontward forcing the support rack 84 to move against the elastic mechanism 86 and to disengage the extrusion parts of the body locking latches 70*a*, 70*b* from the extrusion parts of the door locking latches 26*a*, 26*b*.

A security lock 56 is movably positioned on the front panel 55 of the main body 10 to lock or unlock the pressing bar 48, as shown in FIG. 1. The security lock 56 may be moved up or down along the front panel 55. When the security lock 56 is positioned down, the door locking mechanism 48 is unlocked and can be pressed down to release the door 12. When the security lock 56 is positioned up, it presses against the door locking mechanism 48 and prevents the door locking mechanism 48 from being pressed down to unlock the door 12. Thus, in conjunction with the latches 70*a*, 70*b* of the body locking mechanism 48, the security lock 56 provides a double security for preventing an unintended release of the door 12. This double security design is particularly advantageous since a gear mechanism 46, which is coupled to the support frame 78 and will mesh with the gear 28 when the door 12 is closed, tends to urge the door 12 open by pressing the body locking mechanism 48 frontward during operation.

One of the principle objects of the present invention is to improve the accessibility of the printing medium within a portable printer. To accomplish this, the present invention mounts the medium roller support 30 on the door 12 to make the medium roller support 30 readily accessible. As compared to the conventional portable printer, the user of the present invention does not have to awkwardly try to replace the printing medium roll which is usually held by a medium roller support coupled to the main body of the conventional portable printer. The present invention also positions the print head 50 and the platen 24 in the main body 10 and on the door 12 respectively to further facilitate easy loading and/or replacement of the printing medium roll. Since the print head 50 and the platen 24 are widely separate when the door 12 is opened, the configurations of the present invention basically eliminate the need for careful threading of the printing medium between a platen and a print head, as a conventional portable printer often requires. These convenient features of the present invention simplify the procedures of replacing a printing medium roll in a portable printer dramatically. In addition, the present invention automatically separates the labels from the protective backing of the label roll during operations as mentioned above. Thus, the present invention provides many particular convenient features as compared to the conventional printers.

A proper alignment of the printing medium relative to the print head 50 is one of the most critical features for having good quality printouts. Most conventional portable printers reduce the likelihood of misalignment problems by positioning the platen and the print head on a same bracket to fix their relative position. Since the medium roller support 30 and the platen 24 of the present invention are separate from the main body 10, where the print head 50 is located, the possibility of misalignment between the platen 24 and the print head 50, and thus between the printing medium and the print head 50, increases due to the separation of the platen 24 and the print head 50, as compared to the conventional single-bracket portable printers. This potential misalignment problem, however, is resolved by providing a print head 50 "floating" on the support frame 78 for automatically adjusting the print head position relative to the position of the platen 24 according to the present invention.

The floating arrangement of the print head 50 allows the print head 50 to be adjustable for a proper alignment with the platen 24. The pressing force of the elastic mechanism 86 depends on the strength of components, such as the coil springs, of the elastic mechanism 86 and is carefully selected to provide an adequate pressure on the print head 50 against the platen 24. When an initial misalignment occurs between the print head 50 and the platen 24, the elastic mechanism 86 will automatically respond to an uneven pressure between the platen 24 and the print head 50 due to the misalignment and will slightly readjust the orientation of the print head 50 to compensate the misalignment. As mentioned, the print head receptive holes allow the extrusion rods of the support rack 84 move freely within the print head receptive holes. Thus, the print head 50 may also be slightly repositioned vertically for a better alignment with the platen 24. As a result, the initial misalignment will be corrected or at least will not deteriorate to cause more misalignment problems during printing.

Referring to FIG. 1, the portable printer 1 further includes the gear mechanism 46 locating at the left end of the main body 10. A motor 88 positioned within the main body 10 is coupled to the gear mechanism 46 for driving the same. The gear mechanism 46 is also positioned relative to the gear 28 of the door 12 so that the gear mechanism 46 will mesh properly with the gear 28 when the door 12 is closed against the main body 10. Therefore, when the door 12 is closed, the motor 88 is coupled to rotate the gear 28 and the platen 24 in order to move the printing medium.

A wire connector 52, such as a phone jack, may be provided to receive a data transmitting wire (not shown), such as a phone line, for receiving and/or transmitting electronic data for the portable printer 1. In the preferred embodiment, the wire connector 52 is positioned at the lower right side close to the front of the main body 10. A reflective sensor (not shown) may also be mounted on the door 12 at the underside near the opening 16 for sensing the status of the printing medium roll. The reflective sensor is coupled to a signal light 58 positioned on the front panel 55. The reflective sensor faces perpendicularly to the printing medium roll and could measure the distance between the reflective sensor and the surface of the printing medium roll. When the printing medium roll is unwinding to supply printing medium strip for printing, the distance between the reflective sensor and the printing medium roll increases gradually. Thus, the reflective sensor will notify the user by sending an end-of-roll signal to the signal light 58 when the distance between the reflective sensor and the printing medium roll reaches a predetermined value. In the preferred embodiment, the signal light 58 is an LED light. Alternatively, the end-of-roll signal may be a sound or any other optical signals, and any type of commercially available reflective sensors may be used for sensing purposes.

A battery cavity 60 is optionally located at the right side of the main body 10 for receiving a battery or batteries to power the printer 1. The battery cavity 60 is covered by a battery cavity door 61 having a door lock 62 for locking or unlocking the battery cavity door 61. In the preferred embodiment, a lithium ion battery is used, but any other suitable commercially available batteries may be adopted for providing electrical power to the portable printer 1. The main body 10 also comprises a pair of semicircle rings 72*a*, 72*b*, positioning on opposite sides (left and right) of the main body 10, for hooking the portable printer 1 to a holding means, such as a belt of the user. Additionally, a clip 54 may be fixedly coupled to the main body 10 at the bottom. The clip 54 may be used to clip the portable printer 1 to the holding means.

From the foregoing, it will be appreciated that, although specific embodiments of the invention have been described herein for purposes of illustration, various modifications may be made by persons skilled in the art without deviating from the spirit and/or scope of the invention. Particularly, other suitable types of door and body locking mechanisms may be adopted to lock the door 12 to the main body 10. An infrared sensor may also be included to allow the portable printer 1 to transmit electronic data by infrared. Furthermore, the inventive concepts of the present invention may be equally applicable to any portable or non-portable printers and any dimensions of the preferred embodiment may be adjusted accordingly to fit in other alternative embodiments.

What is claimed is:

1. A device, comprising:

a main body, said main body having a cavity;

a door pivotally coupled to said main body at a first end;

a roller support coupled to said door; and adjustment means adapted to couple printing medium rolls of different widths to said roller support, said roller support being adapted to be housed within the cavity of said main body when said door is closed and raised with said door when said door is opened.

2. The device of claim 1, further comprising:

a holding rack perpendicularly secured to said door; and a connecting means for coupling said roller support to said holding rack.

3. The device of claim 2, wherein said connecting means is a screw, said roller support comprising:

a support body having a substantially stepped-cylindrical shape;

a roller support shaft positioned within said support body and coupled to said connecting means for holding said support body, said support body being movably and rotatably coupled to said roller support shaft; and a roller elastic means positioned within said support body and encircling said roller support shaft, said roller elastic means enabling said support body to move horizontally when pressed.

4. The device of claim 1, further comprising:

a support frame positioned within said main body at a second end, opposite to the first, said support frame having a central plate and two side plates perpendicularly coupled to the central plate respectively at opposite ends;

a print head assembly movably coupled to the side plates of said support frame at opposite ends; and a body elastic means horizontally coupled between said print head assembly and the central plate of said support frame, said body elastic means enabling orientation adjustment of said print head assembly such that said print head assembly is essentially floating against said support frame.

5. The device of claim 4, further comprising:

a body locking mechanism pivotally coupled to said support frame at respective side plates, said body locking mechanism having a pair of body locking latches respectively positioned at opposite side of and parallel to respective side plates of said support frame;

a gear system coupled to said support frame; and a motor coupled to said gear system for driving the gear system.

6. The device of claim 5 wherein said print head assembly comprises:

a print head; and a support rack secured to said print head, said support rack being movably threaded through both side plates of said support frame and to both body locking latches of said body locking mechanism, wherein said body elastic means is coupled between said support rack and the central plate of said support frame to allow orientation adjustment of said print head.

7. The device of claim 5, further comprising a lock switch movably coupled to said main body wherein, in a first position, said lock switch prevents said body locking mechanism from being pressed to unlock said door and, in a second position, said lock switch allows said body locking mechanism to be pressed to release said door from being locked to said main body.

8. The device of claim 5, further comprising:

a platen positioned at a second end, opposite to the first, of said door;

a door locking mechanism, said door locking mechanism being properly positioned to latch with said body locking mechanism for locking or unlocking said door; and a gear means coupled to said platen for rotating said platen, said gear means being positioned to mesh properly with said gear system when said door is closed against said main body.

9. The device of claim 8 wherein said door locking mechanism comprises a pair of door locking latches positioned at opposite ends of said platen wherein said platen is rotatably coupled to both door locking latches by threading through respective platen receptive holes of the door locking latches, the pair of door locking latches being properly positioned relative to the respective pair of body locking latches for latching with each other when said door is closed against said main body.

10. The device of claim 9, further comprising:

a roller positioned parallel to said platen, said roller being movably and rotatably coupled to said door locking mechanism by threading through respective roller receptive holes located at opposite sides of said door locking mechanism, said roller being adapted to press against said platen;

a pair of arms rotatably positioned near opposite ends of said roller, said pair of arms having respective shafts coupled to said door locking mechanism through respective arm receptive holes at opposite sides of said door locking mechanism, said pair of arms being adapted to urge said roller to press against said platen; and a pair of poles positioned at opposite ends of said main body, said pair of poles being vertically movable and being properly positioned to urge said respective arms pressing against said roller when said door is closed to said main body.

11. The device of claim 1, further comprising:

a printing medium sensor for providing status signals of the printing medium roll mounted on said roller support; and a status indicating means coupled to said printing medium sensor for receiving the status signals, said status indicating means indicating status of the printing medium roll according to the status signals.

12. The device of claim 11 wherein said status indicating means comprises a LED light.

13. The device of claim 1, further comprising:

a battery chamber positioned in said main body for housing a battery to provide electrical power to the device; and a connector positioned in said main body, said connector being adapted to couple to a connecting means for receiving electronic data communicated to and from the device.

14. The device of claim 13 wherein said connector is a phone jack and said connecting means is a telephone line having a connecting head.

15. The device of claim 1, the roller support further comprising:

a roller support shaft coupled to the roller support; and a first paddle coupled to the roller support shaft at a first end.

16. The device of claim 15, wherein said roller support shaft has at least one circular groove, said adjustment means comprising:

a second paddle having an opening adapted to fit around the roller support shaft and fit into the groove.

17. The device of claim 15, the roller support comprising:

a neck coupled to the first paddle; and a support arm coupled to the neck and adapted to hold media.

18. The device of claim 17, the roller support further comprising an elastic mechanism for coupling the first paddle to the roller support shaft at a first end.

19. The device of claim 18, the elastic mechanism comprising a coil spring.

20. The device of claim 19, the coil spring having a holding frame with a lateral length of about 0.5 inches, the roller support shaft being threaded through the holding frame of the coil spring mechanism.

21. An imaging forming device, comprising:

a main body;

a door pivotally coupled to said main body at a first end;

a roller support secured to said door;

a support frame positioned within said main body near a second end, opposite to the first;

a print head assembly movably coupled to said support frame;

a body elastic means coupled between said print head assembly and said support frame, said body elastic means enabling orientation or position adjustment of said print head assembly such that said print head is essentially floating against said support frame;

a body locking mechanism pivotally coupled to said support frame, said body locking mechanism being adapted to be pressed for releasing said door from being locked against said main body;

a gear system coupled to said support frame;

a platen positioned at a second end, opposite to the first, of said door;

a door locking mechanism, said door locking mechanism being adapted to latch with said body locking mechanism for locking or unlocking said door; and a gear means coupled to said platen, said gear means being positioned to mesh properly with said gear system when said door is closed to said main body.

22. The imaging forming device of claim 21 wherein said body elastic means is a pair of coil springs.

23. The imaging forming device of claim 21, further comprising:

a roller positioned parallel to said platen, said roller being movably and rotatably coupled to the door locking mechanism and being adapted to press against said platen;

a pair of levers rotatably positioned near opposite ends of said roller, said pair of levers being adapted to urge said roller against said platen; and a pair of urging poles positioned at opposite ends of said main body, said pair of urging poles being vertically movable and being properly positioned to urge said respective levers pressing against said roller when said door is closed.

24. The imaging forming device of claim 21 wherein said door locking mechanism comprises a pair of door locking latches positioned near opposite end of said platen and said body locking mechanism comprises a pair of body locking latches positioned correspondingly to respective door locking latches such that the door locking latches and the respective body locking latches latch with each other when said door is closed to said main body.

25. The imaging forming device of claim 21, further comprising:

a printing medium sensor for sensing a status of a printing medium roll mounted on said roller support; and a status indicating means coupled to said printing medium sensor, said status indicating means being positioned on said main body for indicating the status of the printing medium roll.

26. The imaging forming device of claim 21, further comprising a lock switch movably coupled to said main body wherein, in a first position, said lock switch prevents said body locking mechanism from being pressed to unlock said door and, in a second position, said lock switch allows said body locking mechanism to be pressed to release said door from being locked.

27. An imaging device, said imaging device being capable of forming images on labels from a label roll, the imaging device comprising:

a main body, said main body having a receptive room;

a door pivotally coupled to said main body at a first end, said door being adapted to be pivotally opened from or closed to said main body;

a roller support coupled to said door, said roller support being adapted to support the label roll;

adjustment means adapted to couple printing medium rolls of different widths to said roller support, said roller support being adapted to be housed within the receptive room of said main body when said door is closed and raised with said door when said door is opened; and a moving mechanism coupled to said door, said moving mechanism being adapted to move the label roll and to automatically separate labels from a protective backing of the label roll during operation.

28. The imaging device of claim 27, wherein said moving mechanism comprises:

a platen rotatably coupled to said door near opposite ends;

a roller movably and rotatably coupled to said door near opposite ends, said roller being positioned substantially parallel to said platen for pressing against said platen; and a pressing mechanism, said pressing mechanism being adapted to urge said roller to press against said platen when said door is closed to said main body, said pressing mechanism being released from urging said roller to press against said platen when said door is opened from said main body.

29. The imaging device of claim 28, wherein said pressing mechanism comprises:

a pair of stripper arms, said stripper arms rotatably coupled to said door respectively at opposite ends near said roller for urging said roller to press against said platen; and a pair of plungers, said plungers movable positioned in said main body corresponding to said stripper arms for pressing said respective stripper arms when said door is closed to said main body, wherein said stripper arms urge said roller to press against said platen in response to the pressure from said plungers.

30. The imaging device of claim 27, further comprising:

a door locking mechanism coupled to said door at a second end, opposite to the first end;

a body locking mechanism coupled to said main body at the second end, said body locking mechanism being adapted to lock said door with said main body;

a support frame positioned at the second end of said main body; and a print head assembly, said print head assembly being movably coupled to said support frame to allow orientation and position adjustment of said print head assembly.

31. The imaging device of claim 30, further comprising an body elastic means coupled between said print head assembly and said support frame to allow orientation and position adjustment of said print head assembly.

32. The imaging device of claim 31, further comprising a lock switch coupled to said main body at the second end, wherein, in a first position, said lock switch prevents said body locking mechanism from being pressed to unlock said door and, in a second position, said lock switch allows said body locking mechanism to be pressed to release said door from being locked.

33. The imaging device of claim 27, further comprising:

a printing medium sensor for sensing a status of a printing medium roll mounted on said roller support; and a status indicating means coupled to said printing medium sensor, said status indicating means being positioned on said main body for indicating the status of the printing medium roll.

34. The device of claim 27, the roller support further comprising:

a roller support shaft coupled to the roller support; and a first paddle coupled to the roller support shaft at a first end.

35. The device of claim 34, wherein said roller support shaft has a circular groove, said adjustment means comprising:

a second paddle having an opening large enough to fit around the roller support shaft and fit into the groove.

36. The device of claim 34, the roller support further comprising:

a neck coupled to the first paddle; and a support arm coupled to the neck and adapted to hold media.

37. The device of claim 36, the roller support further comprising an elastic mechanism for coupling the first paddle to the roller support shaft at a first end.

38. The device of claim 37, the elastic mechanism comprising a coil spring.

39. The device of claim 38, the coil spring having a holding frame with a lateral length of about 0.5 inches, the roller support shaft being threaded through the holding frame of the coil spring mechanism horizontally.

* * * * *